US005679137A

United States Patent [19]

Erdman et al.

[11] Patent Number: 5,679,137

[45] Date of Patent: Oct. 21, 1997

[54] OPTICAL DIRTY CELL SENSOR FOR AN ELECTRONIC AIR CLEANER

[75] Inventors: John L. Erdman, Eden Prairie; Stephen J. Kemp, Eagan; Mark R. Schoeneck, Bloomington; Maynard L. Thompson, Prior Lake, all of Minn.

[73] Assignee: Honeywell Inc., Minneapolis, Minn.

[21] Appl. No.: 476,968

[22] Filed: Jun. 7, 1995

[51] Int. Cl.[6] ..... B03C 3/72

[52] U.S. Cl. ..... 96/26; 55/274; 95/25; 250/573

[58] Field of Search ..... 96/26; 95/25; 55/274; 250/573, 349; 356/72

[56] References Cited

U.S. PATENT DOCUMENTS

| | | | |
|---|---|---|---|
| 3,089,082 | 5/1963 | Little | 96/26 X |
| 3,324,633 | 6/1967 | Revell | 55/274 |
| 3,488,675 | 1/1970 | Eishold | 95/25 |
| 5,141,309 | 8/1992 | Worwag | 250/573 X |
| 5,311,023 | 5/1994 | Means, Jr. et al. | 250/349 |

FOREIGN PATENT DOCUMENTS

| | | | |
|---|---|---|---|
| 3131546 | 3/1983 | Germany . | |
| 45-21879 | 7/1970 | Japan | 96/26 |
| 2192501 | 1/1988 | United Kingdom . | |

*Primary Examiner*—Richard L. Chiesa
*Attorney, Agent, or Firm*—Edward L. Schwarz

[57] ABSTRACT

An electrostatic air cleaner has at least one hole in one of the plates over which air with charged dirt particles is passed. A light source is mounted adjacent to the hole so as to direct its light through the hole. A light sensor detects the level of light passing through the hole. As dirt particles deposit on the plate, they fill in the hole over a period of time, reducing the amount of light passing through the hole. It is possible by measuring the amount of light passing through the hole, to determine the amount of dirt deposited on the plate. In a preferred embodiment, each of the plates contain a hole in alignment with each of the other plates' holes so that light from a single light source can pass through each of the holes. Such a configuration allows both the light source and the light sensor to be located outside of the entire group of plates.

10 Claims, 2 Drawing Sheets

10
11
12
14
15
16
17a
17b
17c
17d
17e
19a
19b
19c
19d
19e
21a
21b
21c
21d
23
24
26
28
29
36
40a
40b
40c
40d
40e
41
43
45
46
49
50
53
55
82
90
TO DETECTOR
HIGH VOLTAGE SUPPLY
+5v.
ENABLE (FROM FIG.2)

Fig.2
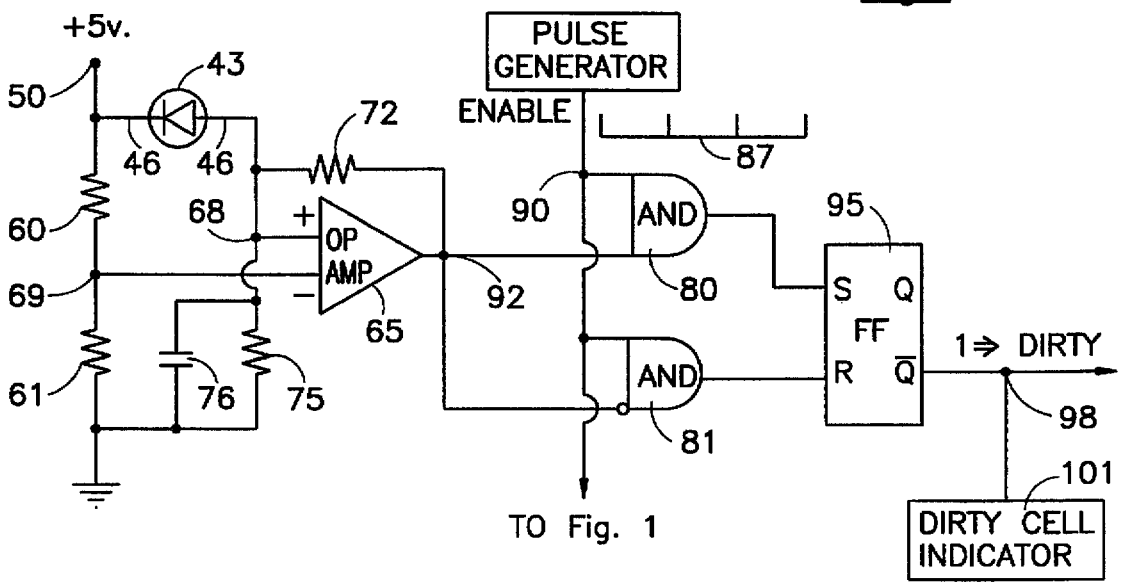
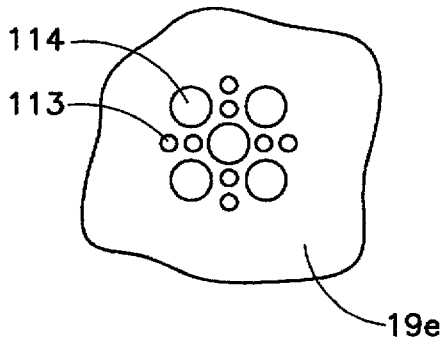
Fig.4
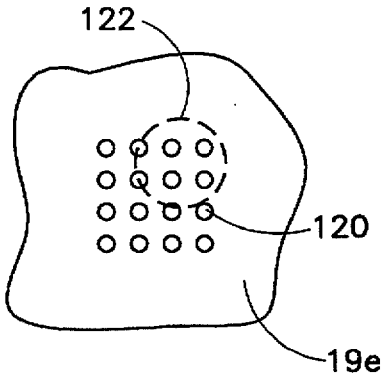
Fig.3

OPTICAL DIRTY CELL SENSOR FOR AN ELECTRONIC AIR CLEANER

BACKGROUND OF THE INVENTION

Nearly all of the particulate contaminants can be removed from air by passing it through an electronic air cleaner. An electronic air cleaner has high voltage ionizer wires arranged in a suitable pattern in the inlet. Downstream from the ionizer wires, a stack of precipitator plates in a parallel, spaced apart arrangement. Alternate plates are electrically charged by an intermediate voltage and the plates between them are held at ground potential. A fan creates air flow through the ionizer wires and into the spaces between the precipitator plates. Airborne particles in the air stream pick up charges from the wires as they pass by them. The charges on the particles causes them to precipitate or accrete on the plates carrying the intermediate voltage.

Over a period of use, the airborne particles build up on the plates and ionizer wires. This particle buildup causes the efficiency with which the particles are precipitated to drop. The plates and ionizer wires are typically combined in a single module which can be removed for cleaning. Indeed, the modules in the smaller units for home use are designed to be cleaned by washing in a dishwasher.

One of the problems associated with electronic air cleaners is determining when the accumulation of particles is sufficient to require that the plates be cleaned. Since these units are typically installed in poorly accessible furnace and air conditioning plenums and most of the surfaces on which particles deposit are concealed from view, it is not easy to visually determine the amount of particle buildup. Because of this, it has been convenient to provide an indication of the level of particle buildup. Some electronic air cleaners now provide an indication that cleaning of the module is necessary by sensing a decrease in the ionizer wire current as the particle buildup on the ionizer wires increases. However, we have found that ionizer current is not always an accurate measure of particle buildup. Accordingly, a different mechanism for sensing particle buildup would be advantageous.

BRIEF DESCRIPTION OF THE INVENTION

We have devised an apparatus for directly measuring the amount of particle buildup on the flat precipitator plates in a electrostatic air filter. This apparatus in essence optically determines when the thickness of the layer of deposited particles on such plates exceeds a predetermined value.

Our apparatus has on at least one of said plates, a test area permitting light to pass through said plate from a first side of the plate to a second side of the plate. A light source is mounted adjacent to the test area on the first side of the plate in alignment with the test area so as to direct at least a portion of light from the light source through the test area to the second side of the plate. A light sensor is mounted on the second side of the plate. The light sensor has a sensing area which, in response to light falling on said sensing area, provides a sensing signal whose magnitude is a function of the intensity of the light falling on the sensing area. Said light sensor is mounted on the second side of the plate with its sensing area in alignment with the test area so as to receive on the sensing area, light directed through the test area from the light source. A level detector receives the sensing signal and provides a status signal having a first level responsive to the level of the sensing signal falling above a predetermined level, and a second level otherwise.

In our embodiment, a signaling device provides a visual or auditory signal responsive to the status signal having a selected one of the first and second levels. Typically, the signaling device will be a light source which emits light when the status signal achieves the level which indicates that light passing through the test area has fallen to below a predetermined level.

BRIEF DESCRIPTION OF THE DRAWINGS

FIG. 2 shows a circuit for detecting the quantity of dirt present on the plates of the an electronic air cleaner.

FIGS. 3 and 4 show alternative designs for the apertures in the test area.

DESCRIPTION OF THE PREFERRED EMBODIMENTS

Figure 1:
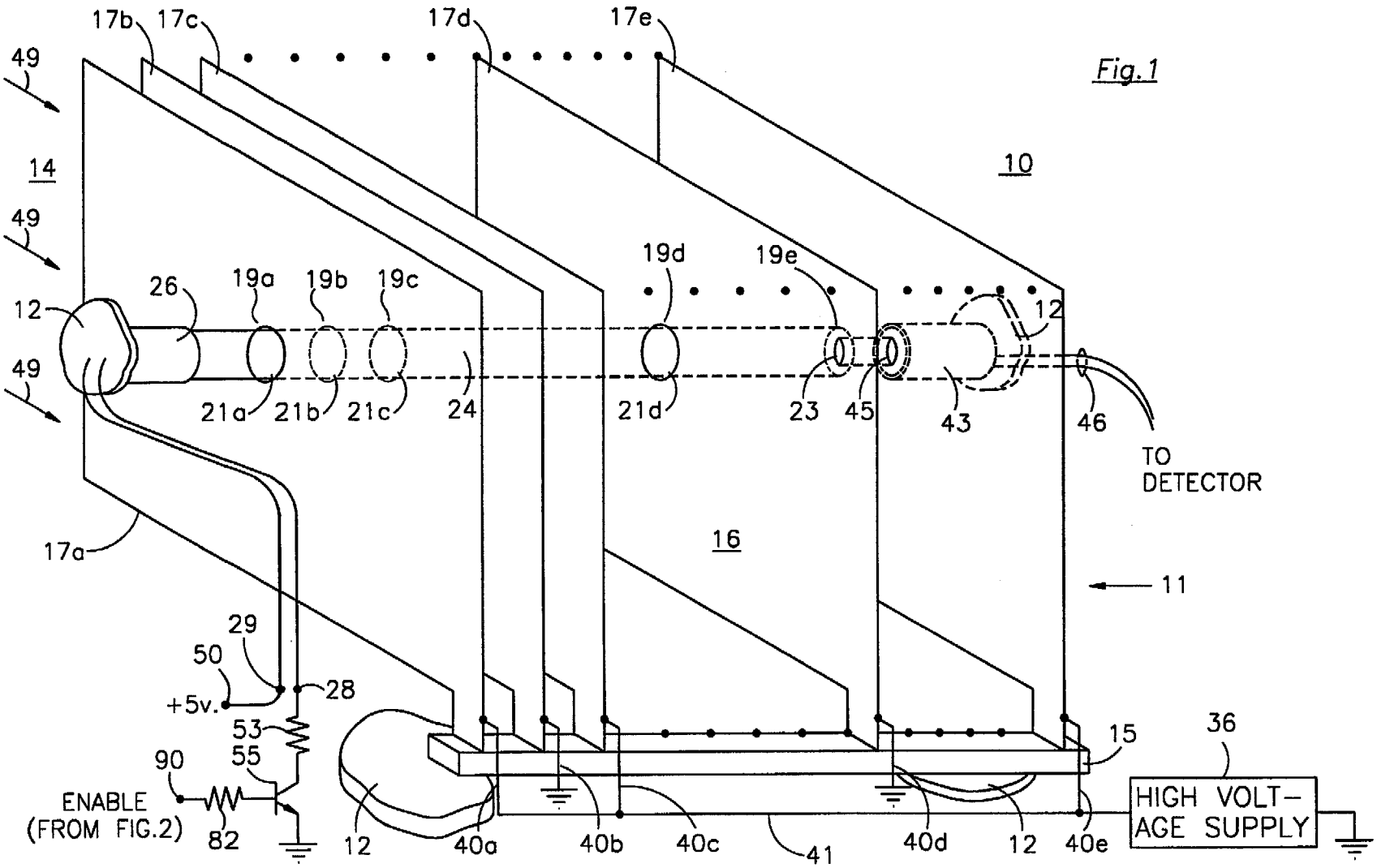
FIG. 1 discloses a combined mechanical perspective drawing and circuit diagram illustrating the features of the invention.

Turning first to FIG. 1, therein are shown parts of a conventional electrostatic air filter 10 to which the improvement of the invention has been added. Since the invention is an improvement to the conventional electrostatic air filter design, it is unnecessary to show all of the individual features of such a filter. Thus, only a number of relevant surface sections of a case 12 which forms the outer surfaces of filter 10 are shown. A partially shown bracket 15 is mounted within case 12. A plurality of flat, conductive precipitator plates of which only a few representative plates **17*a*–17*e* are shown are mechanically mounted on bracket 15. The three sets of dotted lines between plates 17*c* and 17*e* symbolize the missing plates. Plate 17*a* may be considered a first outer plate having an outer side or surface facing the viewer, and plate 17*b* may be considered a second outer plate having an outer side or surface facing away from the viewer. There may be from 20 to 70 individual plates 17*a*–17*e* etc. In a typical design for such a filter 10, bracket 15 along with plates 17*a*–17*e* etc. form a rigid unitary precipitator or collector assembly 11 which can be easily removed from case 12 for cleaning or service, and then reinserted into case 12. Plates 17*a*–17*e* etc. are arranged in spaced, parallel relationship with each other. The spacing between an adjacent two of the plates 17*a*–17*e*** etc. will typically be from three to eight mm.

Plates **17*a*–17*e* etc. must be formed from a conductive material such as aluminum. In the embodiment here, plates 17*a*, 17*c*, and 17*e* are mounted on bracket 15 by a means which insulates them from bracket 15 or any other parts of filter 10 which are conductive. The insulation must allow plates 17*a*, 17*c*, 17*e*, etc. to withstand a voltage potential difference of at least several thousand volts between them and any adjacent grounded conductive element of filter 10 such as case 12 or bracket 15. There is electrical connection to plates 17*a*, 17*c*, etc. by connectors 40*a*, 40*c*, 40*e*, etc. and voltage bus 41. A high voltage power supply 36 provides a voltage of several thousands of volts through bus 41 to plates 17*a*, 17*c*, 17*e*, etc. by connectors 40*a*, 40*c***, etc.

Plates **17*b*, 17*d*, etc. are physically located between plates 17*a*, 17*c*, etc., and electrically grounded. The grounding is shown by ground wires 40*b* and 40*d* for the two plates 17*b* and 17*d*. In one design, bracket 15 may be conductive and electrically as well as mechanically connected to plates 17*b*, 17*d*, etc. Bracket 15 in this case may form an electrical connection with a conductive case 12** which may serve as the system electrical ground.

Filter 10 has an inlet side shown generally at 14 into which a flow of air occurs, as symbolized by arrows 49. A fan (not shown) is located at an outlet side of filter 10 shown generally at 16. The fan causes air flow from the inlet side 14 to the outlet side 16 through the spaces between plates 17*a*–17*e*. Filter 10 includes a set of ionizer wires (also not shown) in positions near the inlet side 14 of filter 10. The ionizer wires are energized with a voltage whose level is on the order of that provided by power supply 36.

In operation, air is drawn past the ionizer wires and through the spaces between plates 17*a*–17*e* etc. Particles which contaminate the incoming air receive an electrical charge from the ionizer wires and attach themselves to the plates 17*a*–17*e* etc. Over a period of time, these particles tend to build up on plates 17*a*–17*e* etc. and it is necessary to periodically clean the plates 17*a*–17*e* etc. and the ionizer wires to remove these attached particles. It is for this reason we prefer to design bracket 15 and plates 17*a*–17*e* etc. as a removable unit. If plates 17*a*–17*e* etc. are not periodically cleaned, the voltage gradient between high voltage plates 17*a*, 17*c*, 17*e* etc. and ground plates 17*b*, 17*d*, etc. drops, causing a loss of efficiency in the precipitation of particles on plates 17*a*–17*e* etc. In extreme cases, particle buildup may be so great that arcing between the ground plates 17*b*, 17*d*, etc. and the high voltage plates 17*a*, 17*c*, etc. may occur. While this is not a hazardous condition, it further reduces the efficiency of the filter 10. Accordingly, it is desirable to clean plates 17*a*–17*e* etc. whenever the particle buildup is great enough to seriously affect the efficiency of filter 10 performance. Because these filters may be installed in poorly accessible locations, there is substantial motivation to provide a function for remotely indicating when the plates 17*a*–17*e* etc. are so dirty that cleaning is required.

Our improvement provides an easily read indication of a dirty cell, and provides a very reliable means for selecting the threshold for the amount of dirt present on the plates 17*a*–17*e* etc. Each individual plate 17*a*–17*e* etc. has a test area 19*a*, 19*b*, etc. in each of which is present an aperture 21*a*, 21*b*, etc. each lower case letter in the ref. nos. indicates the plate 17*a*–17*e* etc. in which it is present. Since the spacing of plates 17*a*–17*e* etc. as shown in FIG. 1 is an approximation of the actual spacing, plates 17*b*, 17*c*, etc. obscure all except aperture 21*a*. Apertures 21*b*, 21*c*, etc. are therefore shown in dotted outline. Each of the apertures 21*a*, 21*b*, etc. is in alignment with every other of the apertures so as to allow a light beam 24 (and which is to be interpreted as including other types of radiation such as infrared) to pass through all of the apertures in the entire set of plates 17*a*–17*e* etc. A light source 26 mounted on a side surface of case 12 generates light beam 24. Source 26 must be aligned so as to allow light beam 24 to project through each of the apertures 21*a*, 21*b*, etc. The light beam 24 can be provided in one preferred embodiment, by an infrared emitting diode (IED).

At least one of the plates 17*a*–17*e* etc., plate 17*e* in FIG. 1, has a test area 19*e* in which is at least one gauge or test aperture 23 which is of a calibrated size. We prefer a circular shape because such a shape is easy to form, although it is possible that other shapes will provide advantages in how dirt accretes to close them. Aperture 23 must be in alignment with each of the other apertures 21*a*, 21*b*, etc. and also with light beam 24. The size of aperture 23 is selected such that deposited air particles will fill it in and substantially attenuate or block the light beam 24 when plate 17*e* has been coated with a layer of dirt particles thick enough to require cleaning of plate 17*e*. We prefer to make apertures 21*a*–21*d* etc. relatively large, to minimize alignment problems, and rely on the calibrated size of aperture 23 to attenuate or block the light beam 24. Apertures 21*a*–21*d* etc. may be from one to two cm. in diameter. Appropriate diameters for aperture 23 might range from 0.03 in. (0.075 cm.) to 0.05 in. (0.125 cm.) depending on the type of air contaminants involved. The underlying assumption is that the amount of dirt blocking light impinging on aperture 23 is representative of the amount of dirt adhering to all of the plates 17*a*–17*e* etc. The gauge aperture 23 diameter should be chosen so than dirt entrained in the air stream passing through the filter 10 will close aperture 23 about the time the coating of dirt on the surfaces of plates 17*a*–17*e* etc. is so thick that cleaning is needed.

We prefer to locate the test areas 19*a*–19*e* etc. approximately midway between the inlet and outlet edges of plates 17*a*–17*e* etc. The cross section of beam 24 should be substantially larger than the aperture 23 so as to minimize alignment problems, and may even be larger than the apertures 21*a*, 21*b*, etc. While it is theoretically possible to locate the gauge aperture 23 in any of the plates 17*a*–17*e* etc., we presently prefer to place it in the outside plate of the plates 17*a*–17*e* etc. and furthest from light source 26, shown as plate 17*e* in FIG. 1. By placing gauge aperture 23 in the outside plate 17*e*, the beam undergoes a minimum of scattering by dirt which may be partially closing aperture 23. Reducing the effect of scatter makes detection of the intensity of light passing through aperture 23 more accurate.

There are a number of variations of our design which may be desirable in certain circumstances and which still allow us to practice this concept. For example, while apertures 21*a*–21*d* etc. and 23 are shown as each being approximately centrally positioned in plates 17*a*–17*e* etc., it is also possible that individual apertures may have the shape of slots or notches which are open at the edges of plates 17*a*–17*e* etc. While the apertures may be located near the edges of plates 17*a*–17*e* etc., we prefer at the present time to locate them as shown near the center of plates 17*a*–17*e* etc. The more central location of gauge aperture 23 may result in more consistent blocking of light beam 24 when the plates 17*a*–17*e* etc. have become so dirty that cleaning is required or desirable.

In our preferred embodiment, light source 26 has a pair of electrical leads 28 and 29. Lead 29 is attached to a source of DC voltage such as a +5 v. source 50 suitable for powering light source 26. Lead 28 is attached to a first terminal of a resistor 53. A transistor 55 connects the other of the resistor 53 terminals to ground. A positive-going enable pulse at terminal 90 is periodically applied to the base of transistor 55 through a current limiting resistor 82. Each time the enable pulse is applied to terminal 90, transistor 55 conducts and current flows through light source 26, causing light beam 24 to project through each of the apertures 21*a*–21*d* etc. to aperture 21*e*.

A light detector 43 senses the amount of light passing through aperture 23. Light detector 43 is mounted on an inside surface of case 12 with a sensor surface 45 facing and aligned with gauge aperture 23. The sensor surface 45 should be substantially larger than the aperture 23 so as to minimize errors arising from misalignment. (It is also possible in theory to minimize misalignment errors with a sensor surface 45 substantially smaller than the aperture 23 if aperture 23 is reasonably large. Since the preferred size of aperture 23 is already quite small however, it is more practical to use a sensor whose sensing surface 45 is substantially larger than aperture 23.) The electrical conductivity of a preferred type of detector 43 depends on the level of light from source 26 falling on sensor surface 45. As aperture 23 becomes filled with precipitated dirt from the air stream flowing through filter 10, less light from source 26 can impinge on sensor surface 45, and the conductivity drops accordingly. Circuitry shown on FIG. 2 and connected by leads 46 to detector 43 detects any change in this conductivity.

As plate 17*e* becomes progressively dirtier during use of filter 10, aperture 23 is slowly closed by an aggregation of dirt particles which have been deposited from the passing air. If this process continues for a sufficient time, aperture 23 will become almost completely opaque to light provided by source 26. The change in the conductivity of detector 43 relative to the conductivity when beam 24 is unobstructed by dirt particles in aperture 23 provides a useful indication of the amount of dirt on plates 17*a*–17*e* etc. The circuitry of FIG. 2 can sense the present conductivity of detector 43, and provide a visual or other indication thereof. This indication informs the human who is responsible for maintenance of filter 10, what is the level of dirtiness of the entire set of plates 17*a*–17*e* etc. because the state of plate 17*e* should be representative of every other plate 17*a*–17*d* etc.

The circuit of FIG. 2 measures the conductivity of detector 43, thereby determining the level of dirt accreted on plates 17*a*–17*e* etc. In this circuit, an operational amplifier 65 converts the signal provided by detector 43 to a logic level value. Detector 43 may be a commonly available photodiode whose impedance drops when light or infrared radiation from source 26 falls on its sensing surface 45. Operational amplifier 65 may be a 324-type unit available from a variety of commercial sources. Operational amplifiers such as amplifier 65 have extremely high input impedances, and also extremely high voltage gains. For purposes of explaining the operation of this circuit, a logic level voltage near 0 v. will be considered a logical 0 and a logic level voltage above 3 v. will be considered a logical 1. The choice of voltage levels for each of the logic level values is totally discretionary for the designer, and a number of different schemes are available depending on the logic circuit selected.

In the circuit of FIG. 2, the cathode of detector 43 is connected by one of the leads 46 to power terminal 50 and the anode of detector 43 is connected by the other of the leads 46 to the + signal terminal 68 of operational amplifier 65. A pull-down resistor 75 is connected between + signal terminal 68 and ground. Capacitor 76 is connected in parallel with resistor 75 to remove high frequency components from the signal at terminal 68. A resistor 72 whose value is substantially larger than resistor 75 is connected between the output terminal 92 of operational amplifier 65 and + signal terminal 68 to increase hysteresis and thereby, operating stability. A voltage divider comprising resistors 60 and 61 is connected between power terminal 50 and ground, and provides a fixed threshold voltage to a – signal terminal 69 of operational amplifier 65.

Amplifier 65 greatly amplifies any positive voltage difference between the signal voltage at + terminal 68 and the threshold voltage at – terminal 69, and provides the amplified voltage at output terminal 92. If + terminal 68 voltage is even slightly more positive than the – terminal 69 voltage, the voltage at output terminal 92 is held near the +5 v. supply voltage, which corresponds to a logical 1 value. If + terminal 68 voltage is even slightly more negative than the – terminal 69 voltage, the voltage at output terminal 92 is held near 0 v., which corresponds to a logical 0 value.

A pulse generator 85 generates an enable signal comprising a train of logical 1 (+3 v.) enable pulses as shown at 87 on path 90. It is convenient to use a commercial version of a timer such as those having the 555 designation to provide the timer function of pulse generator 85. In one embodiment, these enable pulses may have 10 ms. durations and occur at 1 sec. intervals. The FIG. 2 circuit is designed to test for an obstruction of beam 24 only during each enable pulse. Testing for an obstruction of aperture 23 which may block beam 24 only briefly and at relatively lengthy intervals avoids continuous operation of IED 26 and its possible failure. Since typically at least several weeks are needed for the plates 17*a*–17*e* etc. to accrete sufficient dirt to require cleaning, it is not necessary to test for an aperture 23 obstruction oftener than a few times a day at most. However, timers such as the 555 model can provide such a large timer interval only if one uses an inconveniently large capacitor. Testing at one second intervals allows use of a capacitor of reasonable size and will do no harm. The enable pulses from generator 85 are provided on path 90 to non-inverting input terminals of AND gates 80 and 81, and also through resistor 82 to the base of transistor 55 in FIG. 1. If other logical 0 and logical 1 voltage levels for enable signal 87 than those explained above are selected, which do not switch transistor 55 properly, then it will be necessary to select another arrangement for transistor 55 and resistors 53 and 82, according to well known principles of circuit design.

The output terminal 92 of amplifier 65 is connected to another non-inverting input of AND gate 80 and to an inverting input of AND gate 81. The outputs of AND gates 80 and 81 are applied respectively to the set (S) and reset (R) terminals of a flip-flop 95. This logic circuit causes flip-flop 95 to record the inverted value of the most recent logic level value provided by operational amplifier 65 as the current logic value provided by the not-Q output terminal 98. That is, each time an enable pulse is provided, logical 0 and 1 signals respectively are applied to the R and S flip-flop 95 inputs if a logical 1 signal is present on output terminal 92, and the not-Q output terminal 98 then provides a logical 0 signal level. If a logical 0 signal is present on terminal 92, then the R and S inputs of flip-flop 95 receive respectively logical 1 and 0 signals and the not-Q output is a logical 1. The not-Q output 98 of flip-flop 95 controls a visual indication provided by dirty cell indicator element 101. Element 101 may be nothing more than a LED (light emitting diode) which can be directly driven by a +4 v. logic level voltage which represents a logical 1. One can thus see that it is possible to provide a visual indication when the amount of dirt accreted on the plates 17*a*–17*e* etc. of an electronic air filter 10 is such that cleaning the module is advisable.

FIG. 3 shows a variation, where test area 19*e* has a plurality of similar sized circular gauge apertures 120. Detector 43 will indicate loss of light only after a substantial amount of the area of the apertures 120 has been obscured. In one variation, the sensing area must be sufficiently large to receive light from each aperture 120. In another, there may be enough apertures 120 to allow a sensing area shown in dotted outline at 122 to receive light from some but not all of them. The variation in the amount of light is not critical, and when all of the apertures within the outline 122 have nearly filled, the condition will be detectable by the circuit of FIG. 2. This sort of an arrangement will accommodate misalignment between plate 17*e* and detector 43 without providing a faulty indication of plate status.

FIG. 4 shows a further variation, where plate 17*e* carries within a test area 19*e*, a plurality of circular apertures 113 and 114 of at least two different diameters. The possibility which this variation provides is to for the smaller holes 113 to all close to block light more or less simultaneously, which we believe will result in a relatively steep change in the amount of light passing through test area 19*d* with the passage of time and the accretion of additional dirt on plate 17*d*. In this design, one might use a second detector circuit as shown in FIG. 2 with a voltage divider circuit to change the threshold voltage supplied to amplifier 65. In this circuit, detector 43 should be chosen to provide a linear response over some range of impinging light intensity. This permits a first indication when the plates have reached some intermediate level of particle accretion, say 75% of the amount of accreted dirt which causes substantial reduction in operating efficiency. When the larger holes 114 are nearly closed, the second circuit will detect this condition, meaning that plates 17*a*–17*e* etc. have lost most of their capability to remove dirt from air passing through them.

What we claim is:

1. In a electrostatic air filter having a plurality of substantially flat plates including first and second outer plates to be electrically charged and between which air having electrically charged particles may be passed, to thereby cause said particles to deposit themselves on said plates, an improvement for determining when a predetermined amount of said particles have been deposited on said plates, comprising a) on each of said plates, a test area having an aperture permitting light to pass through said plate from a first side of the plate to a second side of the plate, the aperture in each plate's test area in alignment with every other plate's aperture, wherein a preselected one of the test areas has a gauge aperture substantially smaller than the aperture in each of the other test areas;

b) a light source mounted adjacent to the outer side of the first outer plate and aligned with the test area to direct at least a portion of light from the light source toward the test area of the first outer plate, wherein the light source is mounted to direct light through the aperture in every test area;

c) a light sensor having a sensor surface and responsive to light falling on said sensor surface, providing a sensing signal whose magnitude is a function of the intensity of the light falling on the sensor surface, said light sensor mounted adjacent to the outer side of the second outer plate with its sensor surface in alignment with the test area of the second outer plate to receive on its sensor surface, light from the light source; and d) a level detector receiving the sensing signal and providing a status signal having a first level responsive to the level of the sensing signal exceeding a predetermined level, and a second level otherwise.

2. The improvement of claim 1, wherein the sensor surface of the sensor is substantially larger than the aperture in the preselected one of the test areas.

3. The improvement of claim 2, wherein the preselected one of the test areas is on an outside plate.

4. The improvement of claim 3, wherein the plurality of plates has first and second outside plates, wherein the preselected one of the test areas is on the first outside plate, and the light source is mounted adjacent to the outside surface of the second outside plate.

5. The improvement of claim 4, wherein each test area is centrally located in its plate.

6. The improvement of claim 1, wherein each test area is centrally located in its plate.

7. The improvement of claim 6, wherein the light source includes a switching circuit responsive to a predetermined level of an enable signal for gating power to the light source, and wherein the level detector includes a gating circuit responsive to the predetermined level of the enable signal for gating to a memory unit the present level of the sensing signal, and means for providing the enable signal having periodic intervals in which is attained the predetermined level.

8. The improvement of claim 1, wherein the test area includes a plurality of apertures.

9. The improvement of claim 8, wherein the preselected test area includes at least two circular apertures of gauge substantially identical diameter.

10. The improvement of claim 1, wherein the light source includes a switching circuit responsive to a predetermined level of an enable signal for gating power to the light source, and wherein the level detector includes a gating circuit responsive to the predetermined level of the enable signal for gating to a memory unit the present level of the sensing signal, and means for providing the enable signal having periodic intervals in which is attained the predetermined level.

* * * * *